United States Patent [19]

Teeter et al.

[11] Patent Number: 4,773,886

[45] Date of Patent: Sep. 27, 1988

[54] WATER SKI BINDING

[75] Inventors: Roger C. Teeter, Sumner; David M. Curmi, Renton; Lawrence C. Smith, Kirkland, all of Wash.

[73] Assignee: ERO International Limited, Kowloon, Hong Kong

[21] Appl. No.: 773,879

[22] Filed: Sep. 9, 1985

[51] Int. Cl.[4] ..... A63C 15/06

[52] U.S. Cl. ..... 441/70; 280/11.3; 280/633

[58] Field of Search ..... 441/70; 280/11.31–11.34, 611, 616, 618, 623, 625, 627, 628, 629, 630–634

[56] References Cited

U.S. PATENT DOCUMENTS

| | | | |
|---|---|---|---|
| 23,349 | 3/1859 | Charlton | 280/11.3 |
| 3,133,296 | 5/1964 | Pierson | 441/70 |
| 3,143,750 | 8/1964 | Kluge | 441/70 |
| 3,231,911 | 2/1966 | Clifton | 441/70 |
| 3,254,352 | 6/1966 | Lockwood | 441/70 |
| 3,703,013 | 11/1972 | Leach | 441/70 |
| 3,731,328 | 5/1973 | Russell | 441/70 |
| 4,279,048 | 7/1981 | Bundschuh et al. | 441/70 |
| 4,389,200 | 1/1983 | O'Brien | 441/70 |
| 4,494,939 | 1/1985 | Calapp et al. | 441/70 |
| 4,522,603 | 6/1985 | Doyle | 441/70 |

FOREIGN PATENT DOCUMENTS

| | | | |
|---|---|---|---|
| 65793 | 3/1956 | France | 441/70 |

*Primary Examiner*—Sherman D. Basinger
*Assistant Examiner*—Jesûs D. Sotelo
*Attorney, Agent, or Firm*—Lockwood Alex Fitzgibbon & Cummings

[57] ABSTRACT

The instep and the heel retaining elastomeric parts of a water ski binder are each shaped with the underside having inwardly and upwardly extending projections. Each shaped part is then secured to a separate plate having recesses to match the projections and to secure the part to the plate. The plates, with mounted parts, are then secured to a base plate; with the plate holding one of the parts longitudinally adjustably with respect to the base plate.

34 Claims, 6 Drawing Sheets

WATER SKI BINDING

BACKGROUND OF THE INVENTION

Water ski bindings typically call for a boot made up of a toe piece shaped and located to cover and retain the instep, and a heel piece shaped and located to retain the heel. Those toe and heel pieces need to be adjustable with respect to each other to permit accepting and retaining different size feet. One way to accomplish the adjustment is to have one of the parts longitudinally adjustable with respect to the other part. The typical method to accomplish this has been to have a pair of upwardly extending spaced apart studs that are secured to the ski. The studs extend up into elongated slots in a clamp that adjustably holds the foot retaining member. When properly positioned the unit is secured by wing nuts that engage threads on the ends of the studs, or by cam latches that are secured to the upper end of the studs.

It was found that adjustment may be accomplished by a completely different method.

SUMMARY OF THE INVENTION

A foot retaining part of a water ski binder has lower projections that extend inward and upward to fit into a plate having matching recesses along its lower side. The joined foot retaining part and plate is then joined to the top of a water ski. To adjustably secure the joined foot retaining part and plate to a water ski the plate is first adjustably secured to a second plate; which in turn is secured to the top of the water ski.

DESCRIPTION OF THE PREFERRED EMBODIMENTS

Figures 1, 4:
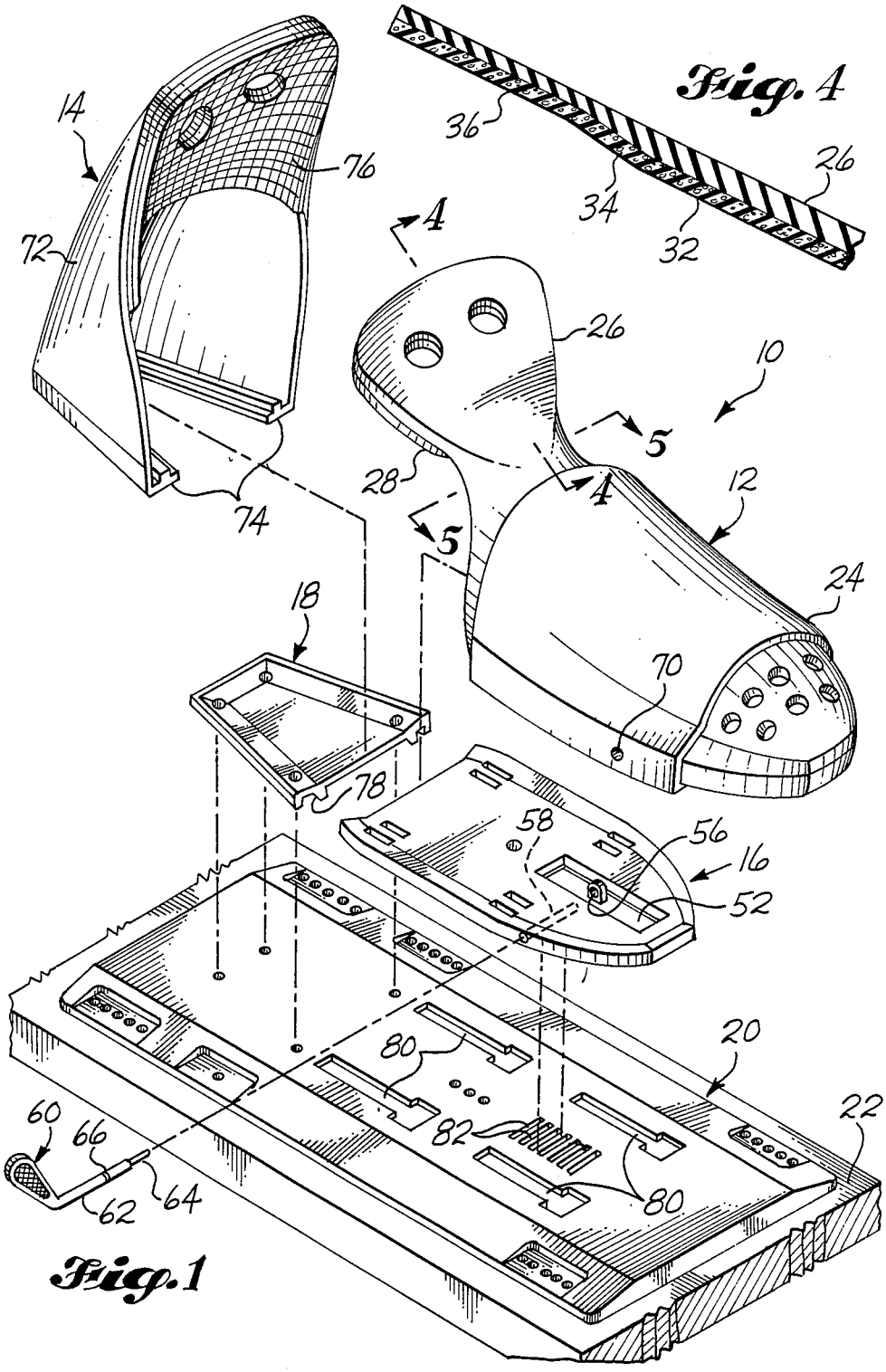
FIG. 1 shows an exploded perspective view of the binder of this invention with an adjustable toe piece.
FIG. 4 shows a cross-sectional view taken along line 4—4 of FIG. 1.
Figure 2:
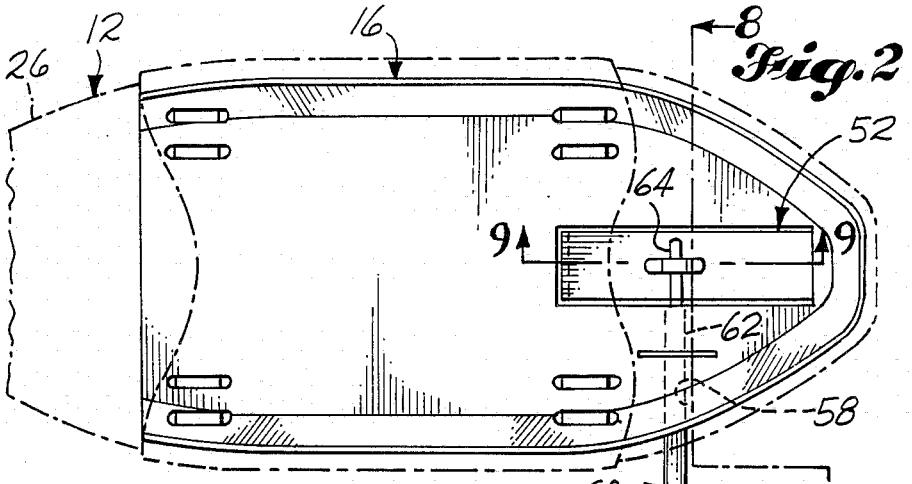
FIG. 2 shows a top plan view, partly in phantom, of the toe part of the binder shown in FIG. 1.

A water ski binding unit 10, has a toe piece 12, and a heel piece 14; which act in conjunction with toe plate 16, heel plate 18, and base plate 20, to secure the binding to a water ski 22.

Figure 5:
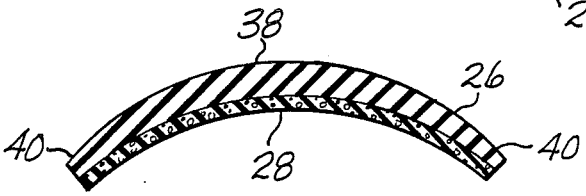
FIG. 5 shows a cross-sectional view taken along line 5—5 of FIG. 1.

The elastomeric toe piece 12, is shaped at 24 to hold the instep, has a tongue section 26, a foamed elastomeric liner 28, and preformed projections 30 that extend inwardly and upwardly. The tongue is contoured, as is best shown in FIGS. 1,4 and 5. FIG. 4 shows the tongue to be thicker at 32 near the base, tapers off at 34, and is thinner at 36. FIG. 5, shows the tongue is thicker in the middle at 38 than it is at each side 40.

Figure 3:
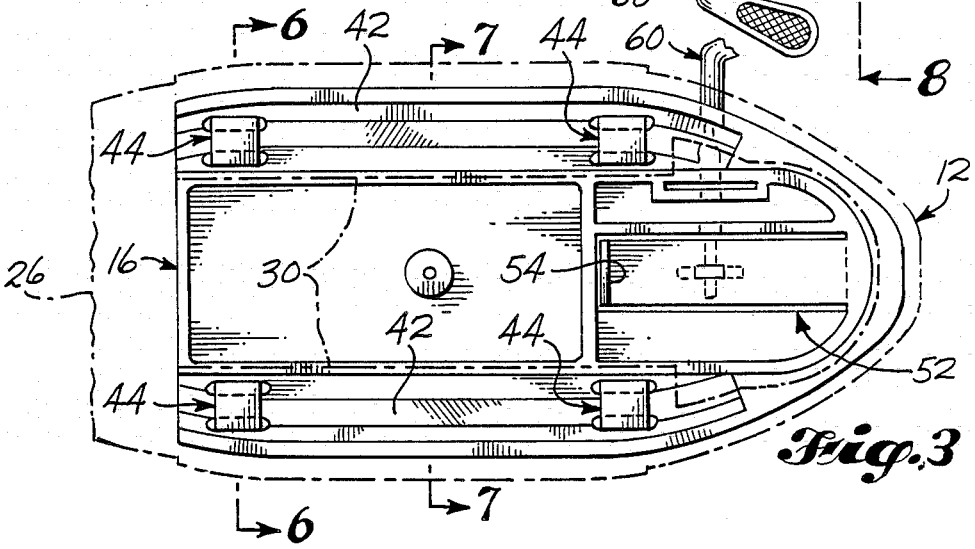
FIG. 3 shows a bottom plan view, partly in phantom, of the toe part of the binder shown in FIG. 1.
Figure 6:
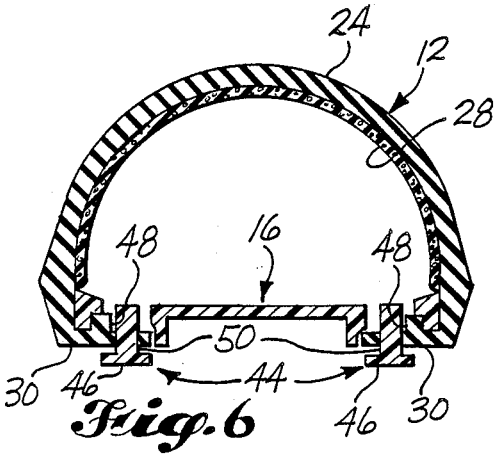
FIG. 6 shows a cross-sectional view taken along line 6—6 of FIG. 3.
Figure 7:
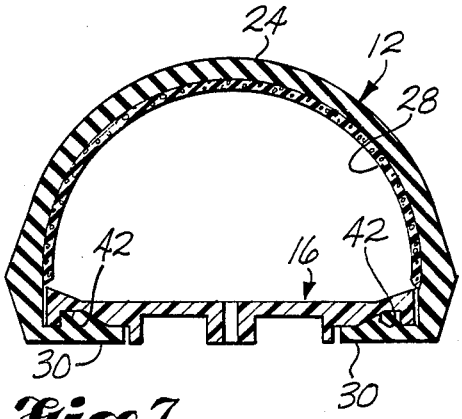
FIG. 7 shows a cross-sectional view taken along line 7—7 of FIG. 3.
Figure 8:
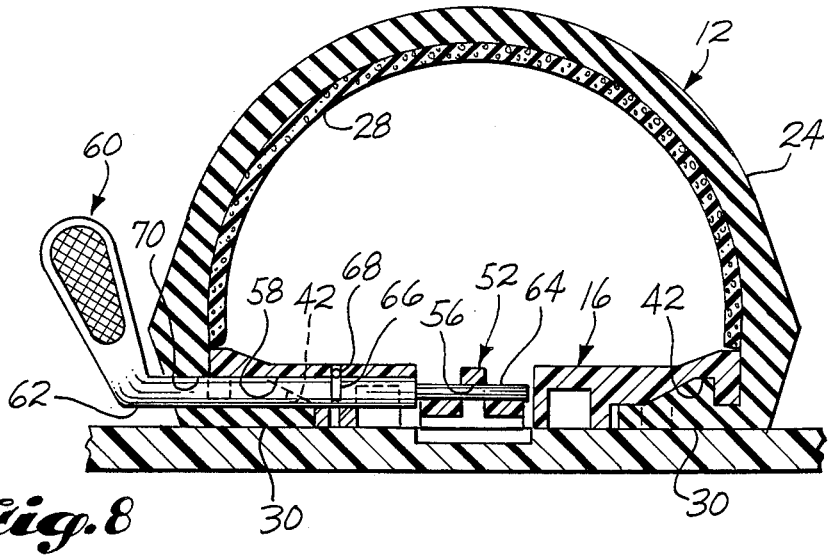
FIG. 8 shows a blown up cross-sectional view taken along line 8—8 of FIG. 2.
Figure 9A:
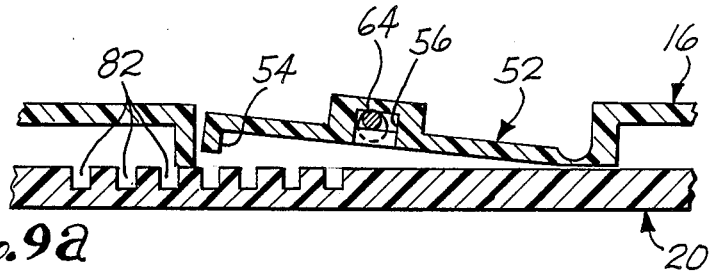
FIG. 9*a* shows a blown up cross-sectional view taken along line 9—9 of FIG. 2, with a latch in the release position.
Figure 9B:
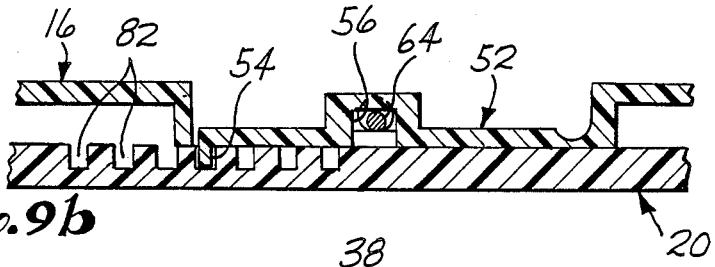
FIG. 9*b* shows a blown up cross-sectional view taken along line 9—9 of FIG. 2, with the latch in the locked position.

The toe plate 16, is preferably shaped to fit inside the toe piece 12, and has recesses 42 along the underside shaped to match the toe piece projections 30 to hold the toe piece and toe plate together. The toe plate also has a set of four T-shaped tabs 44, as is best shown in FIGS. 3 and 6, that extend downward and are essentially flat on the end 46. The projections on the toe piece have a set of four openings 48 located and sized to open to permit the tab ends to pass through then to snuggly hold against the stems 50 of the tabs. The plate also has an integral cantilevered latch 52, with downwardly extending projections 54 on the end, and a laterally extending opening 56, at about midpoint along the length. The plate also has an opening 58, extending in from the side that is axially aligned with the opening in the latch. A latch lever 60, has a shaft 62, with a smaller off-center shaft 64 on the end. The lever also has a circular recess 66, located to be held by a wire 68. The toe piece 12, has an opening 70, aligned to permit insertion of the latch lever.

The elastomeric heel piece 14, is preferably formed with a shaped elastomeric outer member 72, that on the underside has an inwardly and upwardly extending projection 74, and a foamed resilient liner 76. Heel plate 18, is preferably shaped to fit inside the heel piece and has a recess 78 shaped to match and to accept the projections on the heel piece to hold the two parts together.

The base plate 20, has four slots 80, shaped to accept and retain the four tabs 44 in a manner to permit longitudinal movement of the toe plate with attached toe piece. It also has a set of laterally extending recesses 82, that are shaped and located to accept end 54 of the cantilevered latch 52, to normally relative movement of plates 16 and 20. The heel piece 14 and heel plate 18 are secured to the base plate by screws, not shown. The base plate with mounted parts is secured to the top of a ski 22, by screws not shown.

Figure 10:
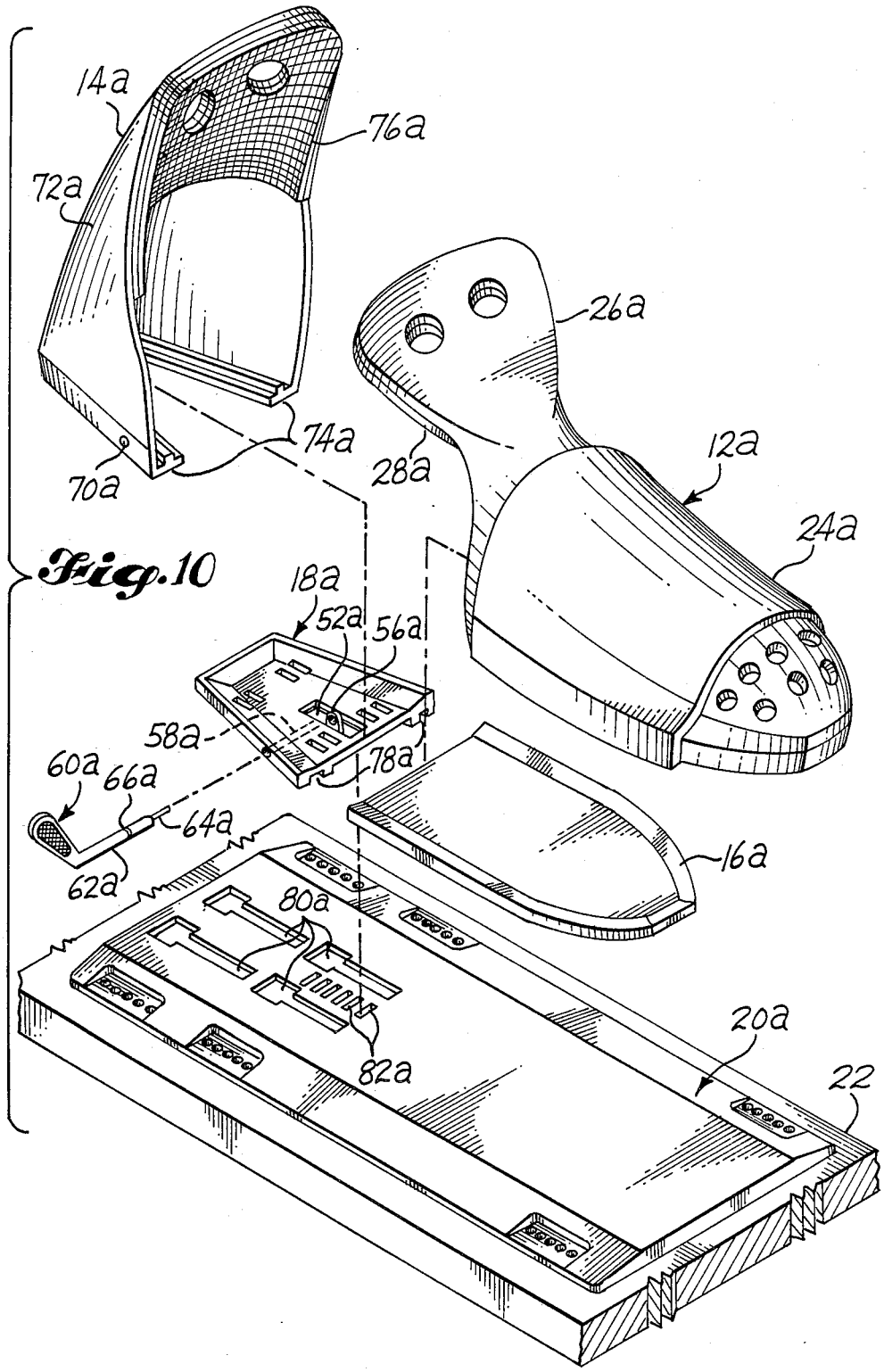
FIG. 10 shows an exploded perspective view of the binder of this invention with an adjustable heel piece.

FIG. 10, shows an embodiment where the heel piece 14*a*, is longitudinally adjustable with respect to the toe piece 12*a*. In this embodiment, the toe piece and the heel piece are the same as the toe piece 12 and heel piece 14, except toe piece 12*a* does not have an opening 70 for accepting a latch lever 60, and the heel piece does have an opening 70*a*, to accept a latch lever 60*a*.

Toe plate 16*a* is shaped to fit inside the toe piece 12*a*, and has recesses along each underside that are shaped to match and to retain the inwardly and upwardly extending projections of the toe piece. The toe plate is secured to base plate 20*a* with screws, not shown.

The heel plate 18a is shaped as in heel plate 18, and has recesses 78a to match and to accept heel plate projections 74a. In addition, the heel plate has a lateral opening 58a, a cantilevered latch 52a with downwardly extending end projections 54a, and an aligned laterally extending opening 56a located at about midpoint along its length, and a set of four T-shaped tabs that extend laterally downward. A latch lever 60a with shaft 62a, recess 66a, and a smaller offset shaft 64a on the end. This lever is used to move the cantilevered latch between free and locked positions.

The base plate 20a, has a set of four slots 80a, shaped and located to accept the four tabs, and to permit longitudinal movement of the heel plate with attached heel piece. It also has a set of laterally extending recesses 82a, shaped to accept the downwardly extending projection on the end of the cantilevered latch 52a. Once the units are secured to the base plate, that plate is secured with screws, not shown, to the top of the water ski 22.

In yet other embodiments, as are shown in FIGS. 11 through 16, there is shaped elastomeric toe pieces 84, a shaped elastomeric heel piece 86, and a base plate 88 that when assembled is secured to a water ski 90. The toe piece along the lower edges has inwardly and upwardly extending projections 92. The heel piece, along the lower edges, has inwardly and upwardly extending projections 94. The base plate has recesses 96, that are sized to match and to accept the projections on the toe piece to hold the two parts together. The base plate also has recesses 98, sized to match and to accept the projection on the heel piece to hold the heel piece to the base plate. Once the parts are assembled the base plate is joined with screws, not shown, to the top surface of the water ski.

Figure 11:
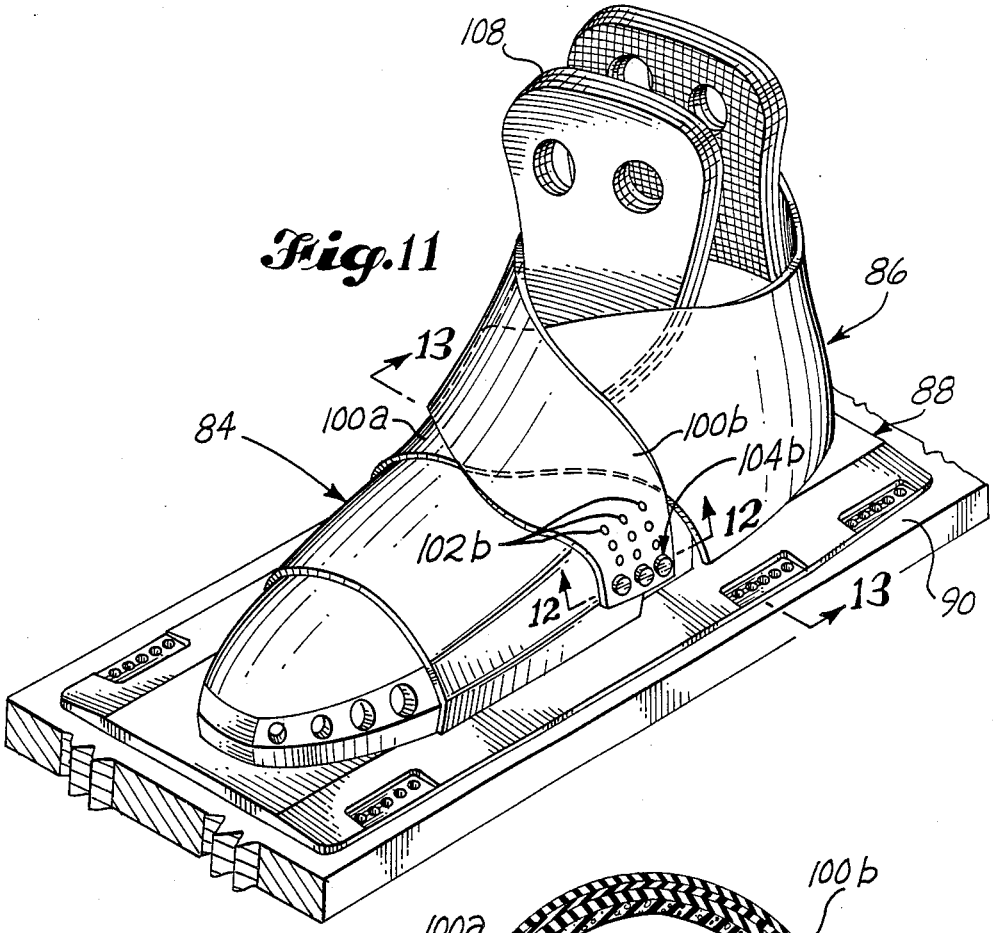
FIG. 11 shows a perspective view of a different embodiment of this invention.
Figure 13:
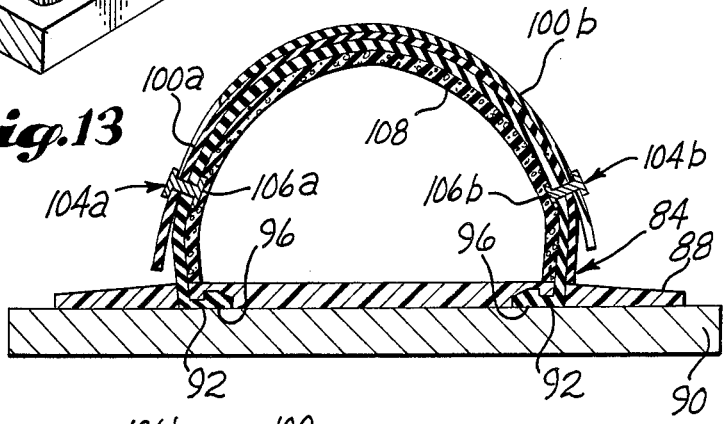
FIG. 13 shows a cross-sectional view taken along line 13—13 of FIG. 11.
Figure 12:
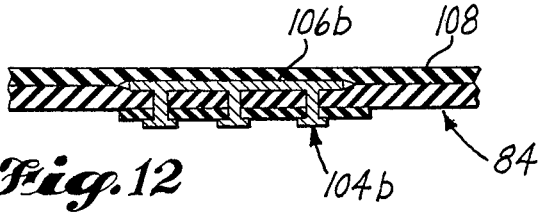
FIG. 12 shows a cross-sectional view taken along line 12—12 of FIG. 11.

In an embodiment as shown in FIGS. 11 through 13, the heel piece 86 has an elongated strap 100a extending forward from one side with a series of holes 102a located adjacent the end, and an elongated strap 100b extending forward from the other side with a series of holes 102b located adjacent the end. There is a set of tabs 104a secured to one side of the toe piece 84, and a set of tabs 104b secured to the other side of the toe piece. The tabs are secured with a base 106a and 106b, located between the side of the toe piece and a foamed elastomeric lining 108. The straps extend forward, cross over, and are adjustably secured to the toe piece with the tabs holding to the holes.

Figure 14:
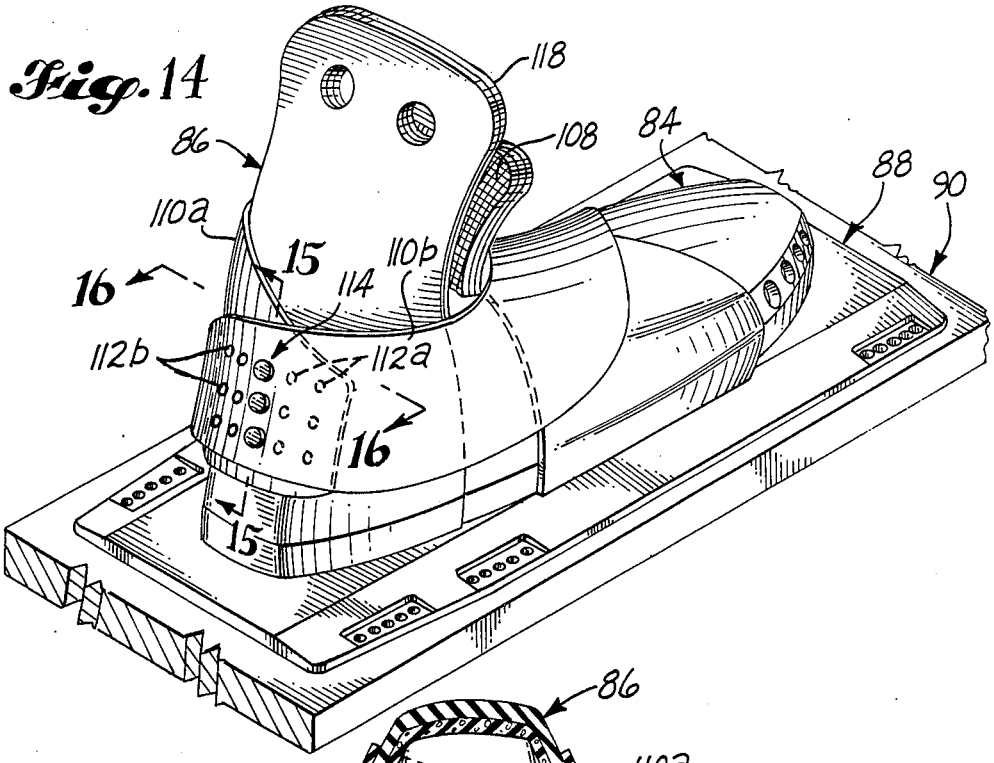
FIG. 14 shows a perspective view of a different embodiment of this invention.
Figure 16:
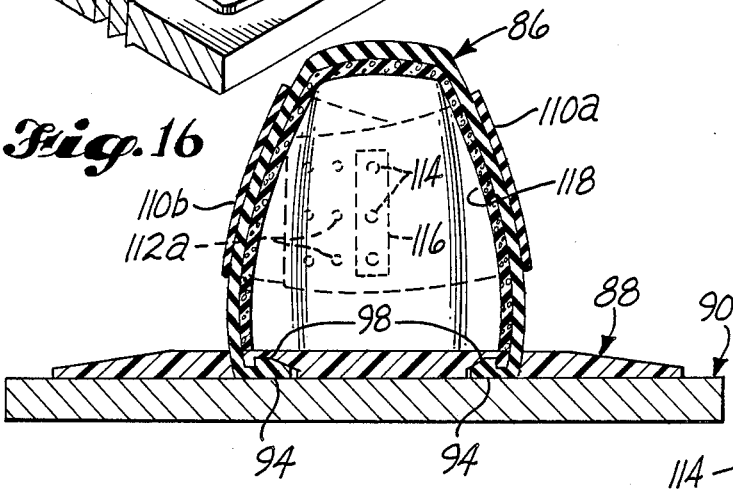
FIG. 16 shows a cross sectional view taken along line 16—16 of FIG. 14.
Figure 15:
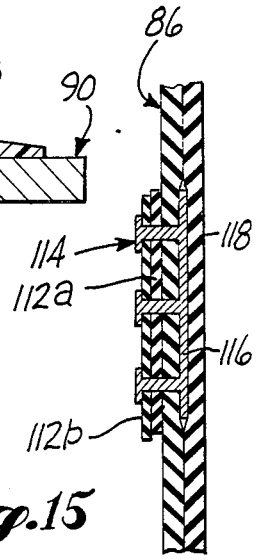
FIG. 15 shows a cross-sectional view taken along line 15—15 of FIG. 14.

In yet another embodiment as shown in FIGS. 14 through 16, the toe piece 84 has an elongated strap 110a extending rearward from one side with a series of holes 112a located adjacent the end, and an elongated strap 110b extending rearward from the other side with this strap having a series of holes 112b located adjacent the end. A series of tabs 114, is vertically mounted along the back of the heel piece 86 with a base 116 secured between the heel piece and a foamed elastic liner 118. The straps extend rearward, cross over, and are adjustably joined to the tabs on the heel piece.

We claim:

1. A water ski binding, adapted to be mounted to the top of a water ski, comprising: a foot retainer means having laterally and upwardly extending elongated projections at the lower portion thereof, and a plate having recesses shaped to match and to accept the projections and hold the foot retainer means, wherein the foot retainer means comprises a pair of shaped elastomeric members including a first member shaped to confine the forward part of a person's foot and a second member shaped and located to confine the heel of a person's foot, the second member having a pair of elongated elastomeric straps to overlap the first member and each strap having a series of holes adjacent the end, and a set of tabs secured along each side of the first member to adjustably accept and hold the ends of the overlapped elastomeric straps.

2. A water ski binding, adapted to be mounted to the top of a water ski, comprising: a foot retainer means having laterally and upwardly extending elongated projections at the lower portion thereof, and a plate having recesses shaped to match and to accept the projections and hold the foot retainer means, wherein the foot retainer means comprises a pair of shaped elastomeric members including a first member shaped to confine the forward part of a person's foot and a second member shaped and located to confine the heel of a person's foot, the second member having a set of tabs vertically located to extend outward at the rear of the member, the first member having a pair of elongated elastomeric straps to overlap behind the second member and each strap having a series of holes adjacent the end to adjustably secure the overlapping straps to the tabs on the second member.

3. A water ski binding, adapted to be mounted to the top of a water ski, comprising: a foot retainer means having laterally and upwardly extending elongated projections at the lower portion thereof, and a plate having recesses on the lower surface thereof shaped to match and to accept the projection and hold the foot retainer means, the bottom surfaces of said projections being substantially coplanar and wherein the foot retainer means comprises an elastomeric strap shaped to fit against and hold the instep of a person's foot.

4. A water ski binding adapted to be mounted to the top of a water ski, comprising: a foot retainer means having laterally and upwardly extending elongated projections at the lower portion thereof, and a plate having recesses on the lower surface thereof shaped to match and accept the projections and hold the foot retainer means, the bottom surfaces of said projections being substantially coplanar and wherein the foot retainer means comprises a pair of shaped elastomeric members including a first member shaped to confine the forward part of a person's foot and a second member shaped and located to confine the heel of a person's foot, further comprising means for adjustably moving one of the pair of elastomeric members with respect to the other member.

5. A water ski binding of a boot mounted to the top surface of a water ski with the boot having foot retaining members including an instep retaining toe member and a heel retaining member, and one of the foot retaining member is longitudinally adjustable with respect to the other member, with the binding having an improvement comprising: one of the foot retaining members having a projection on the lower portion of the member that extends inwardly and upwardly, a first plate having a recess shaped to match the projection and to hold the member, a second plate, and means for adjustably mounting the first plate with its foot retaining member to the second plate.

6. A water ski binding as in claim 5, wherein the adjustable mounting means comprises: one of the plates having at least one longitudinally extending T-shaped slot, the other plate having a T-shaped projection to extend into and slide along the slot, and means for locking the two plates at various adjusted positions.

7. Water ski binding as in claim 5, wherein the adjustable foot retaining member is a toe retaining member.

8. A water ski binding as in claim 7, wherein the toe retaining member further comprises: a contoured tongue section.

9. A water ski binding as in claim 5 wherein the adjustable foot retaining member is a heel retaining member.

10. A water ski binding as in claim 9, wherein the foot retaining member further comprises a contoured tongue section.

11. A binding for a water ski as defined in claim 5 having two foot retaining members including an instep retaining toe part and a heel retaining part, characterized by one of such parts including a pair of elongated, elastomeric straps to overlap the other part, and means for securing the free ends of said straps at alternative desired locations to such other part so as to adjust the effective lengths of said straps.

12. A water ski binding as defined in claim 5, wherein said instep retaining toe member, includes a contoured tongue extending rearward from such toe part and tapering in thickness toward its rear end portion.

13. In the water ski binding defined in claim 12, said tongue tapers in thickness from its central portion toward its opposite side edges.

14. A water ski binding as defined in claim 5 wherein said instep retaining toe member includes a contoured tongue contilevered from such toe part and extending rearward, said tongue tapering in thickness from its central portion toward its opposite side edges.

15. A water ski binding of an adjustable instep retaining toe member comprising: a shaped elastomeric toe member having an inwardly and upwardly shaped lower projection, a first plate shaped to fit inside the toe member with the first plate having a lower surface contoured to match the projection, a second plate, means for permitting reciprocal movement between the two plates, and means for adjustably locking the two plates in position.

16. A water ski binding of an adjustable instep retaining toe member as in claim 15, wherein the means for permitting reciprocal movement between the two plates comprises: the first plate having a set of downwardly extending tabs, and the second plate having recesses shaped to accept, then permit reciprocal movement of the tabs.

17. A water ski binding of an adjustable instep retaining toe member as in claim 16, wherein the means for adjustably locking the two plates in position comprises: the first plate having a cantilevered section with a downward extending projection on the free end, the second plate having a series of slots on the upper side sized to accept and hold the downward extending projection of the cantilevered section, and a lever extending laterally inward to contact the cantilevered section and move it between a free and a locked position.

18. A water ski binding of an adjustable instep retaining toe member as in claim 15, with the elastomeric toe member further comprising a contoured tongue section.

19. A water ski binding of an adjustable heel retaining member comprising: a shaped elastomeric heel member having an inwardly and upwardly shaped lower projection, a first plate shaped to fit inside the heel member with the first plate having a lower surface contoured to match the projection, a second plate, means for permitting reciprocal locking the two plates in position.

20. A water ski binding of an adjustable heel retaining member as in claim 19, wherein the means for permitting reciprocal movement between the two plates comprises: the first plate having a set of downwardly extending tabs, and the second plate having recesses shaped to accept, then permit reciprocal movement of the tabs.

21. A water ski binding of an adjustable heel retaining member as in claim 20, wherein the means for adjustably locking the two plates in position comprises: the first plate having a cantilevered section with a downward extending projection on the free end, the second plate having a series of slots on the upper side sized to accept the downward extending projection of the cantilevered section, and a lever extending laterally inward to contact the cantilevered section and move it between a free and a closed and locked position.

22. A water ski binding comprising: an elastomeric instep retaining toe member having laterally and upwardly extending lower projections, an elastomeric heel retaining heel member having laterally and upwardly extending lower projections, a plate having a series of recesses shaped to accept and along the lower surface match the projections from the toe member to hold that member to the plate, and a second series of recesses shaped to accept and along the lower surface to match the projections from the heel member to hold that member to the plate, the bottom surfaces of said projections being substantially coplanar.

23. A water ski binding comprising: an elastomeric instep retaining toe member having laterally and upwardly extending lower projections, an elastomeric heel retaining heel member having laterally and upwardly extending lower projections, a plate having a series of recesses shaped to accept and along the lower side match the projections from the toe member to hold that member to the plate, a second series of recesses shaped to accept and along the lower side to match the projections from the heel member to hold that member to the plate, a set of outwardly extending tabs mounted to the rear of the heel member, and the toe member having a pair of backwardly extending straps with a series of holes adjacent the end of each strap to overlap around the back of the heel member and adjustably secure it to the tabs.

24. A water ski binding comprising: an elastomeric instep retaining toe member having laterally and upwardly extending lower projections, an elastomeric heel retaining heel member having laterally and upwardly extending shaped to accept, and along the lower side match the projections from the toe member to hold that member to the plate, a second series of recesses shaped to accept and along the lower side to match the projections from the heel member to hold that member to the plate, a set of outwardly extending tabs mounted to each side of the toe member, and the heel member having a pair of forwardly extending straps with a series of holes adjacent the end of each strap to overlap over the toe member and be adjustably secured to the tabs.

25. A method of preparing a water ski binding, with steps comprising: forming elongated inwardly and upwardly extending projections along the bottom of elastomeric toe and heel retaining members, forming recesses on the underside of a plate for matching and retaining the toe and heel projections, and providing access openings through the plate for inserting the projections.

26. A method of preparing a water ski binding as in claim 25, with further steps comprising: securing outwardly extending tabs to the rear of the heel retaining member, forming the toe retaining member with a pair of backwardly extending straps, providing a series of holes adjacent the end of each strap, and overlapping and securing the straps to the tabs.

27. A method of preparing a water ski binding as in claim 25, with further steps comprising: securing outwardly extending tabs to each side of the toe retaining member, forming the heel retaining member with a pair of forwardly extending straps, providing a series of holes adjacent the end of each strap, and overlapping the straps over the toe member and securing the strap ends to the tabs.

28. A method of preparing a water ski binding having an instep retaining toe member and a heel retaining heel member, with one of those members longitudinally adjustable with respect to the other member, and with steps comprising: forming inwardly and upwardly directed projections along the lower side of an elastomeric foot retaining part, forming a plate to fit inside the foot retaining part, providing a recess along the underside of the plate for matching the projections and holding the part to the plate, and adjustably securing the plate with the foot retaining part to a base plate.

29. A water ski binding having a foot retaining member forming a cavity for receiving a portion of the user's foot, characterized by the foot retaining member including a first projection portion extending inwardly and upwardly, and a first plate received in said cavity and having an underside with a first recessed portion shaped to match and to accept said first projection portion for connecting the foot retaining member and said first plate.

30. A water ski binding as defined in claim 29, in which the foot retaining member has opposite bottom edge portions extending generally longitudinally of the ski, the first projection portion extending inwardly and upwardly from one of said bottom edge portions, the foot-retaining member including a second projection portion extending inwardly and upwardly from the opposite bottom edge portion toward the first projection portion, and the underside of the first plate having a second recessed portion shaped to match and to accept said second projection portion.

31. A water ski binding as defined in claim 29, further characterized by two foot retaining members including an instep retaining toe part and a heel retaining heel part, one of said parts including a pair of elongated elastomeric straps to overlap the other part, and means for securing the free ends of said straps at alternative desired locations to such other part.

32. A water ski binding as defined in claim 31, such other part having a set of tabs and the free end portion of each of the straps having a series of spaced holes for receiving said tabs for adjustment of the effective lengths of the straps.

33. A water ski binding as defined in claim 29, further characterized by a base plate for attachment to the upper surface of a ski, and means for adjustably mounting the first plate to said base plate.

34. A binding for a water ski characterized by a shaped elastomeric foot retaining member, a first plate received in and carrying said member, a second plate secured to the ski, one of said plates having a plurality of separate longitudinally elongated slots each having an enlarged portion and the other plate having tabs projecting through said slots, respectively, said tabs having stem portions for sliding in said slots so as to permit relative longitudinal movement of said two plates, said tabs further having enlarged heads normally retaining said tabs in said slots but fittable through said enlarged slot portions, and means for normally locking the two plates together in fixed position

* * * * *